United States Patent [19]

Golden

[11] 4,421,372

[45] Dec. 20, 1983

[54] INSERTION-WITHDRAWAL MECHANISM FOR RACK MOUNTED CIRCUIT BOARDS

[75] Inventor: Raymond Golden, Willowick, Ohio

[73] Assignee: The Babcock & Wilcox Company, New Orleans, La.

[21] Appl. No.: 48,282

[22] Filed: Jun. 13, 1979

[51] Int. Cl.[3] ..... H01R 13/54

[52] U.S. Cl. ..... 339/75 MP

[58] Field of Search ..... 339/74 R, 75 MP:176 MP

[56] References Cited

U.S. PATENT DOCUMENTS 3,963,317 6/1976 Eigenbrode et al. ..... 339/74 R 4,159,861 7/1979 Anhalt ..... 339/75 MP 4,168,877 9/1979 Little et al. ..... 339/91 R

*Primary Examiner*—Joseph H. McGlynn

*Attorney, Agent, or Firm*—Robert J. Edwards; Vytas R. Matas; John F. Luhrs

[57] ABSTRACT

A mechanism for the insertion into and withdrawal from a support structure of a circuit board having an array of male contacts mounted along a lateral edge for engagement with a mating array of female contacts in a zero insertion force connector mounted in the support structure. Means are provided whereby the female contacts must be locked in an expanded position before a circuit board can be inserted into or removed from the support structure.

5 Claims, 5 Drawing Figures

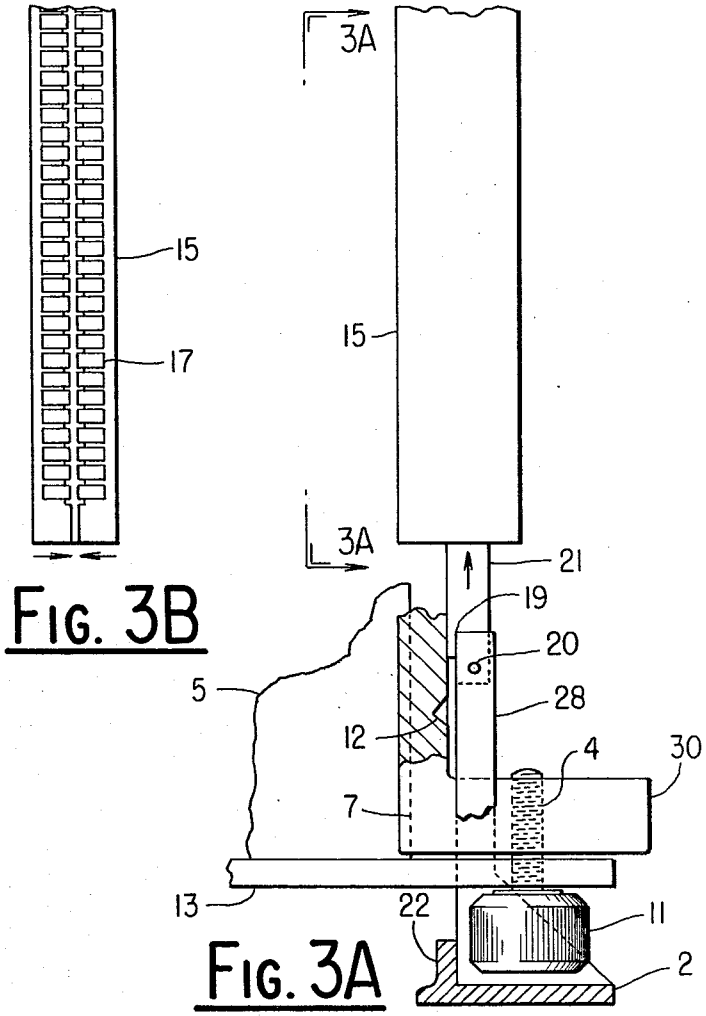
FIG. 3A
FIG. 3B
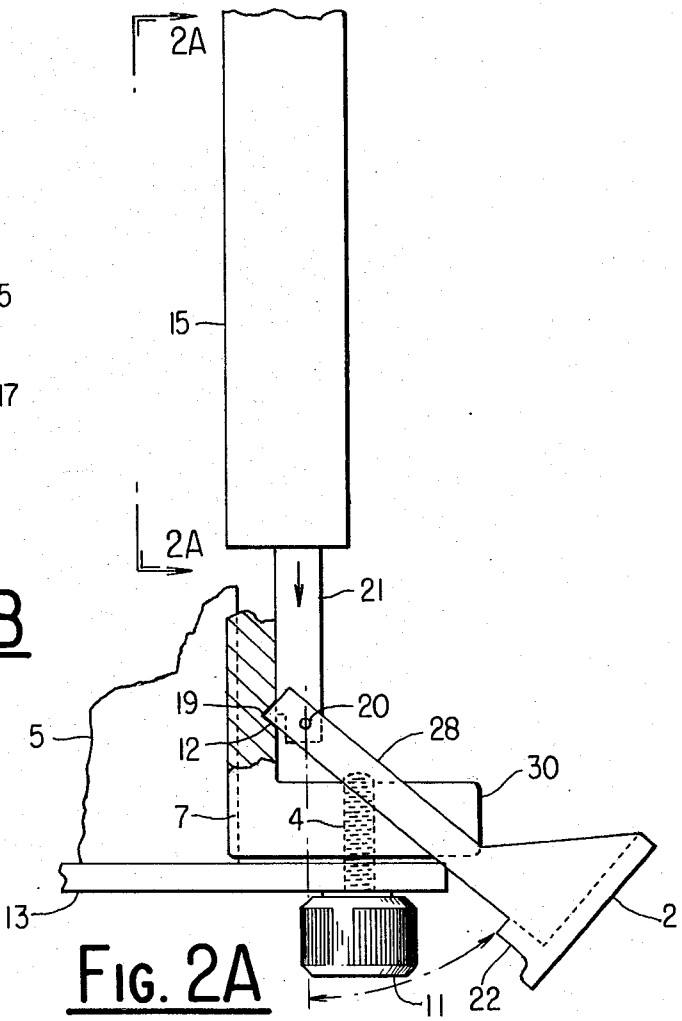
FIG. 2A
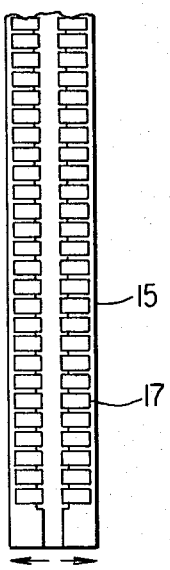
FIG. 2B

INSERTION-WITHDRAWAL MECHANISM FOR RACK MOUNTED CIRCUIT BOARDS

This invention relates to a mechanism for the insertion or removal of a circuit board from a support structure such as a rack or cabinet. More particularly this invention relates to a mechanism for the insertion into or withdrawal from an array of female contacts in a zero insertion force (ZIF) connector mounted in the support structure of a mating array of male contacts on a circuit board.

In accordance with this invention the insertion into or withdrawal of the male contacts from the mating female contacts in the ZIF connector is inhibited unless the female contacts are in the expanded position.

Further in accordance with this invention the female contacts of the ZIF connector are locked in the expanded position during the insertion or removal of the male contacts.

Further in accordance with this invention a predetermined sequence of operations must be followed in inserting or removing a circuit board from the support structure to prevent inadvertent operational errors with consequent damage to the male contacts mounted on the circuit board or the female contacts in the ZIF connector mounted on the support structure.

Further in accordance with this invention a circuit board is firmly locked in the support structure following completion of the insertion sequence of operations as is required for marine, aircraft and nuclear applications.

Further in accordance with this invention inadvertent circuit shorting by mismatch of male and female contacts is prevented.

These and other objectives will be apparent from the following description and from the drawings in which:

IN THE DRAWINGS

FIG. 2A is a fragmentary plan view of the mechanism of this invention in position for inserting or removing a circuit board from the support structure shown in FIG. 1.

FIG. 2B is a fragmentary front elevation view of a typical ZIF connector showing the female contacts in the expanded position.

FIG. 3A is a fragmentary plan view of the mechanism of this invention in the locked position assumed when a circuit board is fully inserted in the support structure shown in FIG. 1.

FIG. 3B is a fragmentary front elevation view of a typical ZIF connector showing the female contacts in the contracted position.

DETAILED DESCRIPTION

Figure 1:
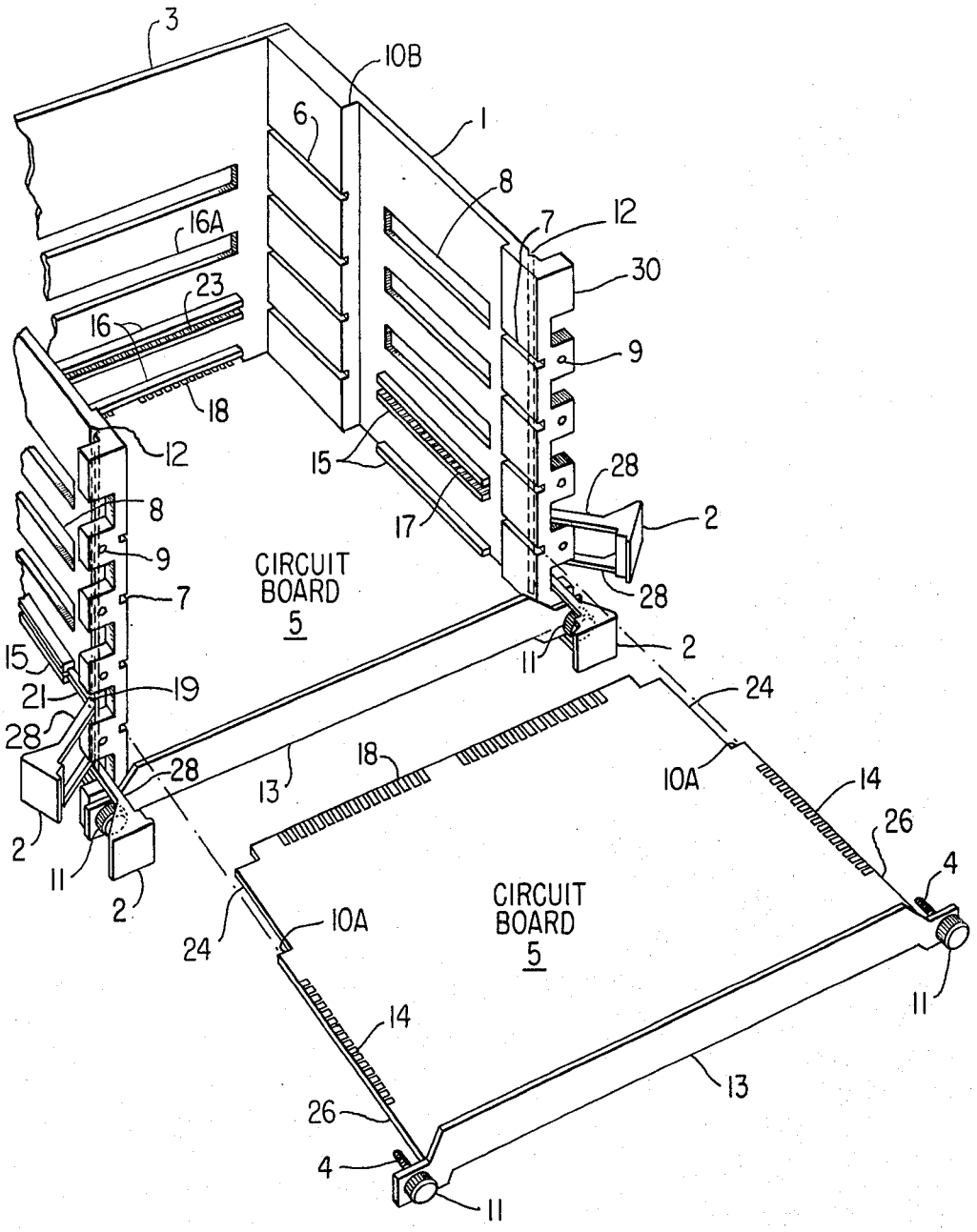
FIG. 1 is a fragmentary perspective view of a typical support structure and circuit boards.

Referring now to the drawings wherein like reference characters designate like or corresponding parts throughout the several views, there is shown a support structure 1 for housing a stack of circuit boards 5. Each circuit board 5 is typically provided with an array of rear male contacts 18 and an array of male contacts 14 mounted along the edge of one or both sides of the circuit board. When inserted in the support structure 1, the array of rear male contacts 14 are aligned with and frictionally engage an array of mating female contacts 23 in a terminal block 16 housed in a slot 16A in the support structure 1. Similarly, each array of side male contacts 14 is aligned with and engages an array of mating female contacts 17 carried in a ZIF terminal block 15 housed in a slot 8 in the support structure 1.

To support and insure lateral alignment of the mating male and female contacts the support structure 1 is provided with rear lateral guide grooves 6 and front lateral guide grooves 7 engaging, respectively, edges 24 and 26 of a circuit board 5. Fully inserted in the guide grooves, shoulders 10A of a circuit board butt against shoulders 10B of the support structure, thus insuring proper alignment of the arrays of male contacts on a circuit board with the mating arrays of female contacts mounted in the support structure.

Each circuit board 5 is provided with a front plate 13 in which are journaled and retained in the extended position jack screws 4, adapted to engage threaded holes 9 in a front face plate 30 of the support structure 1. Manual rotation of knurled heads 11 drive a circuit board to a home or fully inserted position when the shoulders 10A butt against the shoulders 10B.

The ZIF female contacts 17 are moved from an expanded position, shown in FIG. 2B, to a closed or contracted position, shown in FIG. 3B, by means of a linear cam 21, slidably mounted in terminal block 15, which is pushed in to effect contraction and pulled out to effect expansion of the female contacts 17. Such operations are accomplished by means of finger grips 2, having arms 28 and a pivot 20 journaled in the cam 21. The arms 28 are constrained to substantial axial alignment with cam 21, as shown in FIG. 3A, by the rearwardly extending vertical surface of front face plate 30. When, however, pawls 19, formed by the corners of the arms 28 are aligned with detents 12 formed in the face plate 30, finger grips 2 can be swung counterclockwise from the position shown in FIG. 3A to that shown in FIG. 2A. Detents 12 can then receive the pawls 19, locking the cam 21 in the pulled out position and female contacts 17 in the expanded position.

With the arms 28 constrained in substantial axial alignment with the cam 21, the female contacts 17 are in a partial or a completely contracted position and an attempt made to insert or withdraw a circuit board from the support structure could result in serious damage to the male and/or female contacts 14 and 17 respectively. With the pawls 19 in the detents 12, as shown in FIG. 2A, the female contacts 17 are in the expanded position and a circuit board can be freely inserted into or withdrawn from the support structure.

An attempt made to insert a circuit board into the support structure unless the pawls 19 are in engagement with the detents 12 is frustrated by the finger grips 2, which when in axial alignment with the cam 21, form a stop against which shoulders 10A strike. With the pawls 19 in engagement with detents 12, expansion of the female contacts 17 is assured and a circuit board may be easily inserted in the support structure and driven home by means of the jack screws 4. To prevent the arms 28 being brought into axial alignment with cam 21 and an attempt made to push in the cam before a circuit board is homed, each finger grip 2 is provided with a baffle 22, which, as shown in FIG. 2A, clears the knurled head 11 only when a circuit board is homed with shoulders 10A in firm engagement with shoulders 10B. A circuit board cannot be withdrawn from the support structure unless female contacts 17 are in the expanded position, as finger grips 2 cannot be swung to bring the pawls 19 into engagement with the detents 12 until the baffle 22 clears the knurled head 11.

I claim:

1. In a mechanism for the insertion into or withdrawal from a support structure of a circuit board having an array of male contacts mounted along a lateral edge for engagement with a mating array of zero insertion force female contacts mounted in the support structure, a linear cam expanding said female contacts to receive said male contacts when moved to a first position and contracting said female contacts into engagement with said male contacts when moved to a second position, a detent in the support structure and a pawl operatively connected to said cam adapted to engage said detent when said cam is in said first position whereby movement of said cam from said first to said second position is inhibited when said pawl engages said detent.

2. In a mechanism as set forth in claim 1 further including a manually operable lever pivotly connected to said cam for moving said cam from the first to the second position when axially aligned with said cam having a corner forming said pawl brought into engagement with said detent by angular positioning of said lever about said pivot when said cam is in the first position.

3. In a mechanism as set forth in claim 2 further including a stop carried by said lever inhibiting insertion of said circuit board in said support structure while said lever is axially aligned with said cam.

4. In a mechanism as set forth in claim 3 further including locking means for securing said circuit board in said support structure when said arrays of mating male and female contacts are aligned, and a baffle carried by said lever inhibiting axial alignment of said lever with said cam whereby said cam can not be positioned from the first to the second position unless said locking means has secured said circuit board in said support structure.

5. In a mechanism as set forth in claim 4 wherein said baffle further inhibits angular positioning of said lever about said pivot unless said cam is first moved from the second to the first position.

* * * * *